US007721695B2

(12) United States Patent
Moeck et al.

(10) Patent No.: US 7,721,695 B2
(45) Date of Patent: May 25, 2010

(54) CONNECTION ELEMENT FOR THE SECURE FIXING OF A LEVER-TYPE CAM FOLLOWER

(75) Inventors: Stephan Moeck, Pretzfeld (DE); Helmut Engelhardt, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 333 days.

(21) Appl. No.: 11/997,806

(22) PCT Filed: Jul. 27, 2006

(86) PCT No.: PCT/EP2006/007444

§ 371 (c)(1),
(2), (4) Date: Feb. 25, 2008

(87) PCT Pub. No.: WO2007/017132

PCT Pub. Date: Feb. 15, 2007

(65) Prior Publication Data

US 2008/0196682 A1 Aug. 21, 2008

(30) Foreign Application Priority Data

Aug. 5, 2005 (DE) ..... 10 2005 036 918

(51) Int. Cl.
*F01L 1/18* (2006.01)

(52) U.S. Cl. ..... 123/90.39; 123/90.45; 74/569; 74/559; 29/888.2

(58) Field of Classification Search ..... 123/90.16, 123/90.39, 90.44, 90.45, 90.46, 90.48, 90.52, 123/90.55, 90.6; 29/888.2; 74/559, 567, 74/569

See application file for complete search history.

(56) References Cited

U.S. PATENT DOCUMENTS

| | | | | |
|---|---|---|---|---|
| 6,047,675 | A | 4/2000 | Kunz | |
| 7,350,489 | B2 * | 4/2008 | Engelhardt et al. | 123/90.39 |
| 2002/0043233 | A1 | 4/2002 | Speil | |

FOREIGN PATENT DOCUMENTS

| | | | |
|---|---|---|---|
| DE | 29707987 | A | 7/1997 |
| DE | 196 17 523 | A | 11/1997 |
| DE | 19640919 | A | 4/1998 |
| WO | 2004038185 | A | 5/2004 |

* cited by examiner

*Primary Examiner*—Ching Chang
(74) *Attorney, Agent, or Firm*—Lucas & Mercanti, LLP

(57) ABSTRACT

Connecting element (10) retains cam follower (2), which actuates gas-exchange valve (4) of an internal combustion engine, on support element (6). Support element (6) has spherical end (7) on cylindrical section (22) and on which cam follower (2) is mounted, so as to be pivotably movable in the direction of gas-exchange valve (4) about center of rotation (9). Connecting element (10) has elastically deformable projections (21), which proceed from central webs (19), parallel to the pivot axis of cam follower (2) such that connecting element (10) is connected to cylindrical section (22) in a frictionally-engaging manner. Projections (21) are embodied as lugs (20) which angle away from central webs (19) and extend in a direction pointing away from cam follower (2), so that projections (21) are elastic in shape.

5 Claims, 1 Drawing Sheet

CONNECTION ELEMENT FOR THE SECURE FIXING OF A LEVER-TYPE CAM FOLLOWER

FIELD OF THE INVENTION

The invention relates to a connecting element, composed of flat material, for captively retaining a lever-like cam follower, which serves for actuating a gas-exchange valve of an internal combustion engine, on a support element which has a spherical end which merges in a stepless fashion or without an undercut from a cylindrical section and on which the cam follower is mounted, by means of a spherical-cap-shaped formation, so as to be pivotably movable in the direction of the gas-exchange valve about a centre of rotation. Here, the connecting element engages around the cylindrical section with elastically deformable projections, which proceed from central webs, parallel to the pivot axis of the cam follower in such a way that the connecting element is connected to the cylindrical section merely in a frictionally-engaging manner.

BACKGROUND OF THE INVENTION

Connecting elements of said type permit, in a known way, the generation of a module which contains for example a rocker arm as a cam follower and a support element With a module of said type, the risk of potential incorrect assembly in the cylinder head of the internal combustion engine is minimized. Said incorrect assembly could inter alia consist in that the rocker arm is mounted in the valve drive rotated through 180°. In this case, the contact partners the ball head of the support element and spherical cap of the rocker arm, and the valve shank end and corresponding mating surface on the rocker arm, would be interchanged. This would result at least in valve drive malfunction, and in the worst case, even in serious engine damage.

In contrast to connecting elements which engage in a form-fitting manner into an annular groove below the ball head, connecting elements which act in a frictionally-engaging manner can advantageously be used in cases in which the annular groove cannot or cannot economically be produced as an undercut. Further demands on a connecting element of said type are not only that a separation of rocker arm and support element by transport influences is reliably prevented, but also that the rocker arm and the support element remain aligned with respect to one another, corresponding to the operational state, by means of the connecting element even during the assembly of the module into the internal combustion engine. In this respect, the connecting element also performs the task of largely preventing the rocker arm from tilting about its longitudinal axis by means of suitable lateral support on the support element in order to ensure correct transverse alignment of the rocker arm on the camshaft which is to be installed. A tilting of the rocker arm about its longitudinal axis is referred to below as a tilting movement in contrast to its pivoting movement in the direction of the gas-exchange valve.

The prior art has already proposed connecting elements which are connected to the support element in a frictionally-engaging instead of form-fitting manner. U.S. Pat. No. 6,047,675 A, which is considered as being generic, discloses a connecting element which is composed of flat material and which is connected in a frictionally-engaging manner to a support element which has no undercut in the region of the spherical end. Said connecting element has projections which are aligned towards the cylindrical section below the spherical end and which engage around the support element in such a way that a tilting movement of the rocker arm which is mounted on the support element is largely prevented, while the pivoting movement of said rocker arm in the actuating direction of the gas-exchange valve is permitted.

The connecting element proposed in the cited document nevertheless has some significant disadvantages. For example, the projections of said connecting element are of flat design and extend merely in a plane parallel to the pivot axis of the rocker arm. This firstly has the result that a lever arm, which promotes the correct transverse alignment of the rocker arm on the support element, between the contact points of the projections and the centre of rotation of the rocker arm is disadvantageously small. Secondly, on account of the not only flat but also short projections, as a result of their limited material elasticity, it is necessary for the splaying of the projections, which is required for the assembly of the connecting element, to be imparted largely by means of elastic deformation of the webs from which the projections proceed. However, there is the risk here of an undesired warping of the webs, for example in the form of corrugation, torsion or twisting. Such deformation of the connecting element can likewise lead, on account of projections being offset in terms of height, to misalignment of the rocker arm. In connection with said short lever arm, there is additionally an increased risk of the connecting element slipping in the tilting direction of the rocker arm.

Said disadvantageous effect can be further intensified taking into consideration the component tolerances. The cause for this is likewise to be considered the planar, short and consequently comparatively rigid projections, so that both a production-related change in spacing of the projections relative to one another and also a fluctuating diameter of the cylindrical section as a result of additional deformation of the web sections from which the projections proceed must be compensated.

A rocker arm which is aligned correctly on the support element can finally be of significance not only for the transport and assembly of the module but also for fail-safe operation in the internal combustion engine. For example, in the event of a loss of contact between the rocker arm and the actuating cam, the action of the cam which aligns the rocker arm can be lost. Causes for a loss of contact of said type can be undesired subsidence of the most-used support elements with hydraulic valve play compensation, or lifting of the rocker arm from the cam as a result of an excessively high rotational speed of the internal combustion engine. In the phase of contact loss, a "skewed" connecting element would then force the rocker arm in the tilting direction. In this regard, rocker arms with a very narrow cam contact face are to be given particular consideration. These are used in multi-valve engines with restricted installation space or also in variable valve controllers in which a cam pack composed of a plurality of cams of different lift is movably mounted on its camshaft and is placed in engagement with the rocker arm by the cam suitable for the operating state of the internal combustion engine. The rocker arm is then at particular risk with regard to a further tilting movement or completely tilting away from the support element, since in the event of renewed contact with its cam, said rocker arm can no longer be aligned on the cam to a sufficient degree on account of the narrow cam contact face.

OBJECT OF THE INVENTION

It is therefore an object of the invention to create a connecting element of the above-specified type in which the cited disadvantages are eliminated using simple means. It should accordingly be ensured, in contrast to the connecting elements known in the prior art, firstly that the cam follower is held in a sufficiently captive manner on the support element, and secondly that the operational transverse alignment of the cam follower on the support element has an increased level of robustness. Here, robustness is to be understood to mean the stability of the required transverse alignment of the cam follower under the action of disturbance influences, which include for example the previously specified component tolerances.

SUMMARY OF THE INVENTION

Said object is achieved according to the features of Claim 1, while advantageous refinements and embodiments can be gathered from the subclaims. Accordingly, the object is achieved in that the projections are embodied as lugs which are angled away from the central webs and which extend in a direction pointing away from the cam follower, so that as such, the projections are elastic in shape.

The stated disadvantages are in this way eliminated using simple means. The projections which are embodied as lugs engage around the cylindrical section at contact points which are spaced apart from the centre of rotation of the cam follower by a relatively great distance. The lever arm generated in this way is sufficiently large to promote the operational transverse alignment of the cam follower on the support element and to stabilize said transverse alignment against slipping. At the same time, on account of the projections which are inherently elastic in shape, it is ensured that the elastic deformation of the connecting element required for the frictionally-engaging connection on the cylindrical section is imparted primarily by the lugs themselves and only to an insignificant extent by the webs from which the lugs proceed. The risk of the deformation of the webs, which can lead to the misalignment of the cam follower, explained in the introduction is also minimized in that the projections which are elastic in shape are extremely well suited to compensating said component tolerances.

In one preferred embodiment of the invention, the central webs should belong to a closed and substantially planar annular section, which annular section bears against a first side, which faces towards the support element, of a base, which surrounds the spherical-cap-shaped formation, of the cam follower. In order to fasten the connecting element to the cam follower, the annular section has angled holding claws which are aligned in the longitudinal direction of the cam follower and which are latched with holding lugs on a second side, which faces away from the support element, of the base. By means of said embodiment, a rigid connection of the connecting element to the cam follower is obtained. The sufficiently large lever arm is then generated in that the lugs engage around the cylindrical section of the support element at contact points whose spacing, projected onto a longitudinal axis of the support element, to the centre of rotation is greater than a spacing, projected onto the longitudinal axis, of the planar annular section to the centre of rotation.

In addition, the cam follower should be embodied as a rocker arm which has a generally U-shaped cross section and which is produced in a non-cutting fashion from sheet metal material. A moulded part composed of cold-hammered sheet metal material is expediently also to be provided as a connecting element. A connecting element of said type is particularly simple and cost-effective to produce and can be assembled on the cam follower in a reliable manner. One particularly preferred embodiment of the invention is finally given by a combination of the features as specified in Claim 5 and explained above.

BRIEF DESCRIPTION OF THE DRAWINGS

The invention is explained in more detail on the basis of the appended drawings which illustrate an exemplary embodiment and in which.

DETAILED DESCRIPTION OF THE DRAWINGS

Figure 1:
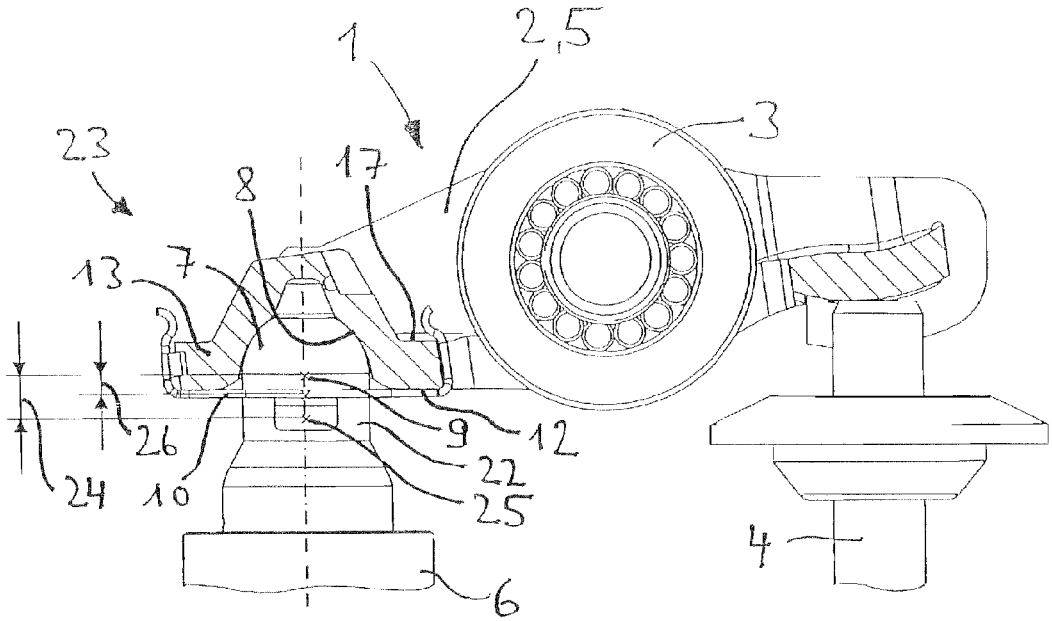
FIG. 1 shows a connecting element according to the invention in the assembled state of a valve drive, with a cam follower shown in longitudinal section.

FIG. 1 illustrates a detail of a valve drive 1 of an internal combustion engine in the assembled state. Illustrated is a cam follower 2 which, in a known way, is driven in the actuating direction of a gas-exchange valve 4 by means of a cam (not shown) via a rotatably mounted roller 3 which is connected to the cam follower 2. It is of course also possible, instead of the roller 3, for a sliding face which is rigidly connected to the cam follower 2 to be provided as a cam contact face. The cam follower 2 is formed in the exemplary embodiment as a rocker arm 5 which has a generally U-shaped cross section in the longitudinal direction and is produced in a cost-effective manner from sheet metal material in a non-cutting shaping process. A support element 6 which is mounted so as to rest in the internal combustion engine has a spherical end 7 on which the cam follower 2 is mounted, by means of a spherical-cap-shaped formation 8, so as to be pivotably movable in the direction of the gas-exchange valve 4 about a centre of rotation 9.

In order to captively retain the rocker arm 5 on the support element 6, a connecting element 10 is provided which is explained in more detail below taking into consideration FIG. 2. The connecting element 10, as a moulded part produced in a non-cutting fashion, is composed of cold-hammered sheet metal material and has a closed annular section 11 which bears against a first side 12, which faces towards the support element 6, of a base 13, which surrounds the spherical-cap-shaped formation 8, of the rocker arm 5. Holding claws 14, 15 which are angled away at 90° and which are aligned in the longitudinal direction of the rocker arm 5 proceed from the annular section 11, which holding claws 14, 15 are latched with holding lugs 16 on a second side 17, which faces away from the support element 6, of the base 13. The connecting element 10 is in this way fixed to the rocker arm 5, with additional angles 18 being provided on the holding claw 14, which assist precise longitudinal alignment of the connecting element 10 with respect to the rocker arm 5. The annular section 11 comprises central webs 19, from which angled projections 21, which are embodied as lugs 20, proceed in a direction pointing away from the rocker arm 5.

The spherical end 7 merges in a stepless manner and without an undercut into a cylindrical section 22 which the lugs 20 engage around parallel to the pivot axis, which runs through the centre of rotation 9, of the rocker arm 5. For this purpose, in the non-assembled state of the connecting element 10, the clear spacing of the lugs 20 to one another is smaller than the diameter of the cylindrical section 22. When the connecting element 10 is pulled over the spherical end 7 onto the cylindrical section 22, the lugs 20 deform elastically and connect the support element 6 in a frictionally-engaging manner to the connecting element 10 which is fixed to the rocker arm 5. In this way, a module 23 composed of the rockier arm 5, the support element 6 and the connecting element 10 is formed, which module 23, in the non-assembled state of the valve drive 1, captively retains the rocker arm 5 on the support element 6. In addition, it is ensured in said state that the rocker arm 5 is aligned with respect to the support element 6 at least so as not to tilt to a great extent. An alignment of said type is promoted by the connecting element 10 and for example stabilized against slipping in that a lever arm 24, projected onto the longitudinal axis of the support element 6, between contact points 25 of the lugs 20 and the centre of rotation 9 of the rocker arm 5 is sufficiently large. For comparison, FIG. 1 shows a considerably smaller lever arm 26 as would be given by non-angled projections as per the cited prior art.

Figure 2:
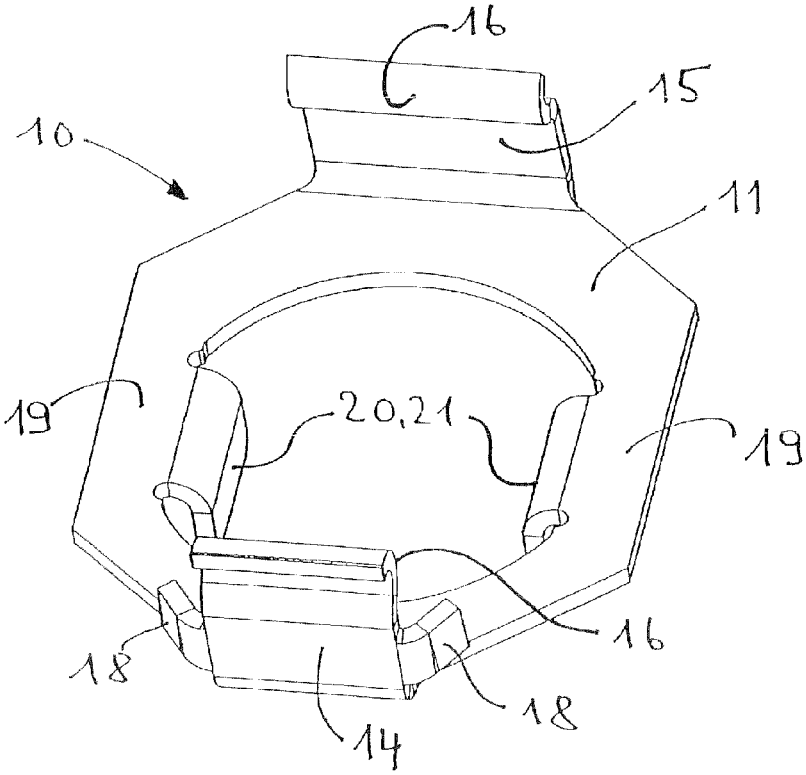
FIG. 2 shows the connecting element as per FIG. 1 in an enlarged perspective illustration.

It can also be clearly seen from FIG. 2 that the lugs 20 are, as such, elastic in shape. This means that the elastic deformation required for pulling the connecting element 10 onto the cylindrical section 22 of the support element 6 is absorbed largely by the lugs 20 and only to a small extent by the webs 19 or by the annular section 11. Accordingly, the risk of corrugation, twisting, torsion or similar deformation of the webs 19 or of the annular section 11 with lugs 20 which correspondingly engage, in a manner offset in terms of height, on the cylindrical section 22, is minimized, and a resulting misalignment of the rocker arm 5 on the support element 6 is largely prevented.

In the illustrated exemplary embodiment, the lugs 20 are designed such that, adjacent to a transition radius, they are planar and angled by in each case 90° with respect to the central webs, and accordingly run parallel. Conically tapering and/or multiply-curved or completely curved lugs are also possible as alternative embodiments.

LIST OF REFERENCE SYMBOLS

1 Valve drive
2 Cam follower
3 Roller
4 Gas-exchange valve
5 Rocker arm
6 Support element
7 Spherical end
8 Spherical-cap-shaped formation
9 Centre of rotation
10 Connecting element
11 Annular section
12 First side
13 Base
14 Holding claw
15 Holding claw
16 Holding lug
17 Second side
18 Angle
19 Web
20 Lug
21 Projection
22 Cylindrical section
23 Module
24 Lever arm
25 Contact point
26 Lever arm

The invention claimed is:

1. A connecting element for a cam follower, which serves for actuating a gas-exchange valve of an internal combustion engine, on a support element which has a spherical end which merges in a stepless fashion or without an undercut from a cylindrical section and on which the cam follower is mounted, by means of a spherical-cap-shaped formation, so as to be pivotably movable in the direction of the gas-exchange valve about a centre of rotation, with the connecting element engaging around the cylindrical section with elastically deformable projections, which proceed from central webs, parallel to the pivot axis of the cam follower in a way that the connecting element is connected to the cylindrical section merely in a frictionally-engaging manner, wherein the elastically deformable projections are embodied as lugs which are angled away from the central webs and which extend in a direction pointing away from the cam follower, so that, the elastically deformable projections are elastic in shape.

2. Connecting element according to claim 1, characterized in that wherein the central webs belong to a closed and substantially planar annular section, which annular section bears against a first side, which faces towards the support element, of a base, which surrounds the spherical-cap-shaped formation, of the cam follower, and which annular section has holding claws which are aligned in the longitudinal direction of the cam follower and which are angled away from the annular section and which are latched with holding lugs on a second side, which faces away from the support element, of the base, with the lugs engaging around the cylindrical section of the support element at contact points whose spacing, projected onto a longitudinal axis of the support element, to the centre of rotation is greater than a spacing, projected onto the longitudinal axis, of the annular section to the centre of rotation.

3. Connecting element according to claim 1, wherein the cam follower is embodied as a rocker arm, has a generally U-shaped cross section and is produced in a noncutting fashion from sheet metal material.

4. Connecting element according to claim 1, wherein the connecting element, as a moulded part produced in a non-cutting fashion, is composed of cold-hammered sheet metal material.

5. Connecting element according to claim 1, wherein the connecting element together with the cam follower and the support element forms a module having the following features:

the cam follower is embodied as a rocker arm which is produced in a non-cutting fashion from sheet metal material and which has a generally U-shaped cross section;

the connecting element, as a moulded part produced in a non-cutting fashion, is composed of cold-hammered sheet metal material;

the central webs belong to a closed and substantially planar annular section, which annular section bears against a first side, which faces towards the support element, of a base, which surrounds the spherical-cap-shaped formation, of the rocker arm, and which annular section has holding claws which are aligned in the longitudinal direction of the rocker arm and which are angled away from the annular section and which are latched with holding lugs on a second side, which faces away from the support element, of the base;

the lugs engage around the cylindrical section at contact points whose spacing, projected onto a longitudinal axis of the support element, to the centre of rotation is greater than a spacing, projected onto the longitudinal axis, of the annular section to the centre of rotation.

* * * * *